United States Patent [19]

Dautremont

[11] 4,226,323

[45] Oct. 7, 1980

[54] PRECISION COIN ANALYZER FOR NUMISMATIC APPLICATION

[76] Inventor: Joseph L. Dautremont, 28 Taxco Ct., Simi Valley, Calif. 93065

[21] Appl. No.: 940,749

[22] Filed: Sep. 8, 1978

Related U.S. Application Data

[63] Continuation-in-part of Ser. No. 707,891, Jul. 22, 1976, Pat. No. 4,128,158.

[51] Int. Cl.[2] ..... G07F 3/02

[52] U.S. Cl. ..... 194/100 A

[58] Field of Search ..... 194/100 R, 100 A, 102; 324/34 R

[56] References Cited

U.S. PATENT DOCUMENTS

| | | | |
|---|---|---|---|
| 2,642,974 | 6/1953 | Ogle | 194/100 R |
| 3,401,780 | 9/1968 | Davin | 194/100 R |
| 3,956,692 | 5/1976 | Weinberg | 194/100 R |
| 4,105,105 | 8/1978 | Braum | 194/100 R |

*Primary Examiner*—Stanley H. Tollberg

*Attorney, Agent, or Firm*—William J. Schneider, Jr.

[57] ABSTRACT

A device for testing coins or other metallic articles is disclosed whereby the article to be tested is introduced into the field generated by the inductor of an oscillator and the change in amplitude of the oscillations resulting from the interaction of the field generated and the article to be tested is measured.

11 Claims, 5 Drawing Figures

PRECISION COIN ANALYZER FOR NUMISMATIC APPLICATION

This application is a continuation-in-part of copending application Ser. No. 707,891, filed July 22, 1976 for Precision Coin Analyzer for Numismatic Application, which was issued Dec. 5, 1978, as U.S. Pat. No. 4,128,158.

BACKGROUND OF THE INVENTION

The testing of coins by electrical means has become increasingly important with the increased use of vending machines. In broad terms these devices seek to separate genuine coins from counterfeit coins. To constitute an economic threat to the vending machine, the counterfeit must cost less than the genuine coin it replaces.

Economic threats to vending machines would seem to be limited to simple counterfeits as metal washers or low denomination foreign coins of similar size and shape which can be economically obtained. The testing devices to fill these needs are relatively crude as suits their task.

Another purpose of coin testing is found in needs of those who purchase bullion coins. In this case a substantial economic threat is posed by a counterfeiter who fabricates a gold exterior resembling a coin on a base metal disk. No collector would physically probe in the inner structure of the coin since in so doing he would destroy much of its numismatic value. Precise electrical methods are of value, since they provide data on the core material by a nondestructive test.

PURPOSE OF THE INVENTION

It is the object of the invention to provide a means of evaluating coins or other metallic articles through a nondestructive electrical test.

It is a further object of this invention to provide a means of evaluating coins or other metallic object of right cylindrical shape so as to minimize variations in sensitivity due to coin size and to provide nearly the same sensitivity for small thin coins as for large thick coins.

Other objects of this invention will become apparent as the description proceeds.

BRIEF DESCRIPTION OF THE DRAWINGS

A better understanding of the invention may be had from a consideration of the following detailed description taken in conjunction with the accompanying drawings in which.

DESCRIPTION OF THE INVENTION

Figure 1:
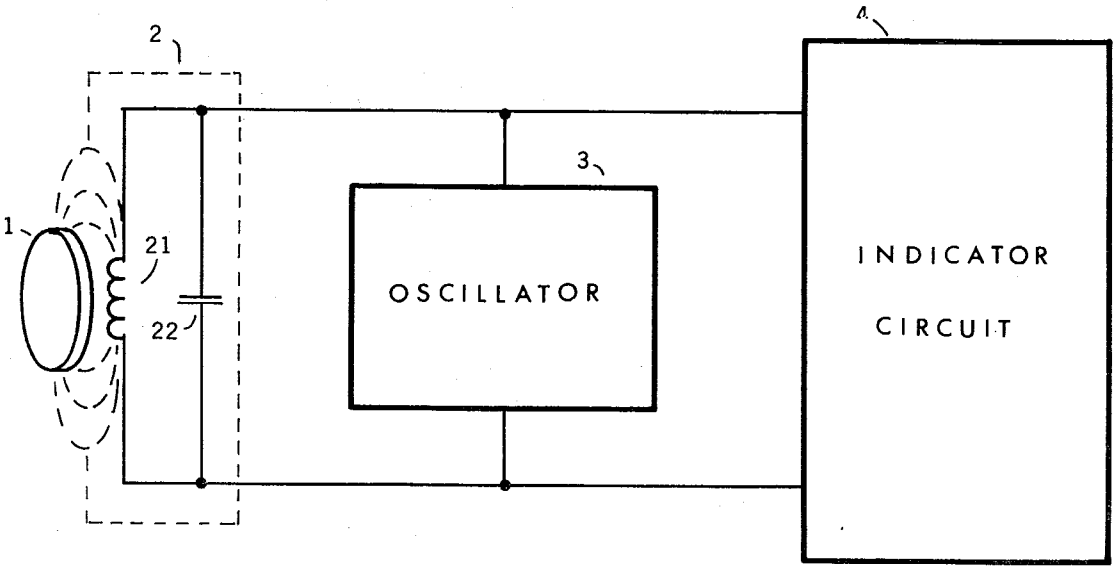
FIG. 1 is a block diagram of a generalized systim in accordance with the invention for the non-destructive testing of coins.

In its basic form, the invention consists of a resonant circuit 2 containing an inductor and a capacitor, together with suitable means of standardizing the relative position of the coin to be tested within the field of the inductor, a two terminal oscillator circuit s which produces an oscillating voltage across the coil terminals, and a metering circuit 4 which measures the amplitude of the oscillating voltage which appears across the coil terminals.

The size and shape of the coin, together with its position relative to the inductor cell are important factors in the testing of coins by this method. Large coins intercept more of the magnetic flux produced by the inductor and therefore causes a greater change in the oscillating voltage than small coins. The magnetic flux is known to be most dense just above the inner surface of a cylinderical coil. Because of the non-uniformity of magnetic flux precise positioning of coins to be tested and compared is important. The non-uniformity also allows the possibility of equalizing the effect of large and small coins on the inductor voltage by positioning small coins in the more dense flux regions and large coins in the less dense flux regions.

Insertion of a coin into the electromagnetic field of the coil causes the oscillator voltage amplitude to change. The amount of change which occurs is then measured and used to classify the coin. The change in oscillator voltage amplitude is a function of the physical dimensions and electrical properties of materials which form the coin. The physical dimensions of the coin determine its inductance as an electrical circuit and the material of the coin determines its electrical resistance and hence the losses encountered when currents are induced in the coin. The relative dimensions and positions of the coin and coil determine the degree to which energy from the field of the oscillator coil is coupled into the coin and the resulting losses. The oscillator voltage amplitude is determined by the inductance of the coin as determined by its size and the resistance of the coin as determined by its constituent materials.

The fact that a coin will absorb energy from an oscillating electromagnetic field is well known and has been widely applied in coin testing. The others who have sought to employ this effect have employed substantially different mechanisms. There are several mechanisms which depend on the application of an oscillator voltage to an inductance bridge circuit wherein the coil is the inductor in an inductance measuring bridge circuit. The bridge error voltage caused by the presence of the coin is measured. There are other applications in which the coin to be tested is interposed between a transmitting coil and a receiving coil wherein the reduction in transmitted energy is measured. These methods differ from the method shown in that none of them seek to measure small changes in the amplitude of oscillations of an oscillator caused by the introduction of a coin.

Large coins intercept more of the magnetic flux from the inductor coil than do small coins and as a result have a greater effect on the inductor voltage. Weinberg in his U.S. Pat. No. 3,956,692; *Metal object comparator utilizing a ramp having a V-shaped slot for mounting the object accurately within the test coil,* has sought to minimize the above effect. Weinberg teaches that a V-slot is effective for both defining the position of a coin in proximity to the windings of the oscillator coil and for tending to equalize the effect of different size coins by permitting smaller diameter coins to come closer to the coil windings than larger diameter coins.

Figure 4A:
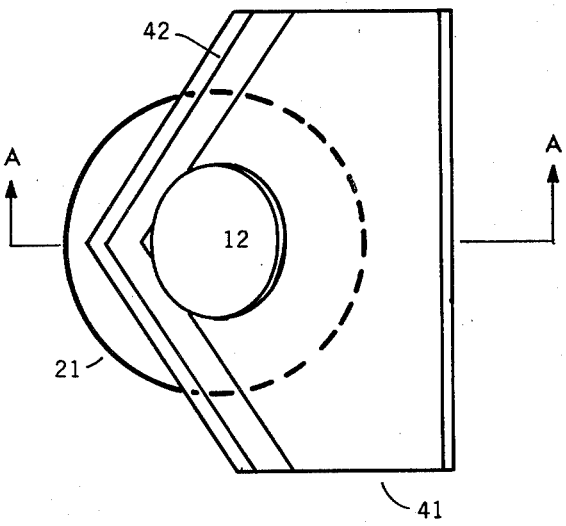
FIGS. 4A and 4B are a series of drawings showing the coin positioning function of the "V" slot known to the prior art and the acute vertex of this invention.
Figure 4A:
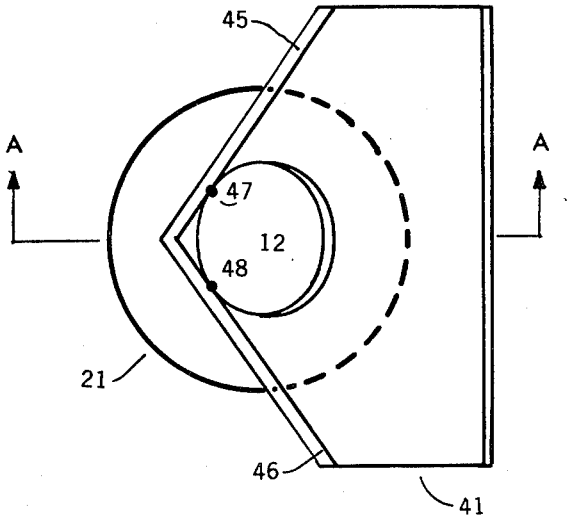
Figure 4A:
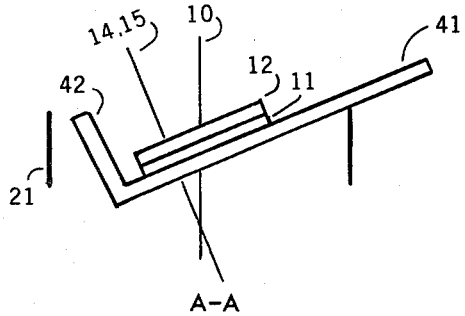

FIG. 4A depicts the inductor coil 21 and positioned within it a ramp 41 and a V-slot 42 formed therein according to Weinberg. Coins 11 and 12 have the same diameter but different thickness, coin 12 being thicker than coin 11. Both coins rest with a flat surface on the ramp and descend until their vertical surfaces contact the walls of the V-slot. Even though the lower flat surface of both coins is positioned identically the upper flat surfaces differ, that of the thicker coin 12 being significantly closer to the windings of the coil 21. The distance from the coin to the windings is important because the flux density increases very rapidly as the windings are approached. In fact it is that portion of the coin closest to the windings that dominates the measurement.

The difficulty with the V-slot is that the position of the upper surface of the coin which approaches the windings most closely is not controlled. The reason for this difficulty is that coins are positioned by moving them down the ramp until their curved surved surfaces becomes tangent to the walls of the V-slot. These lines of tangency 14 and 15 are normal to the ramp. Since the ramp is not normal to the axis 10 of the winding, the lines of tangency cannot be parallel to the axis of the winding and therefore must approach and eventually intersect the winding if extended. As the lines of tangency approach the winding so thicker coins extend along the lines of tangency and approach the winding.

Figure 4B:
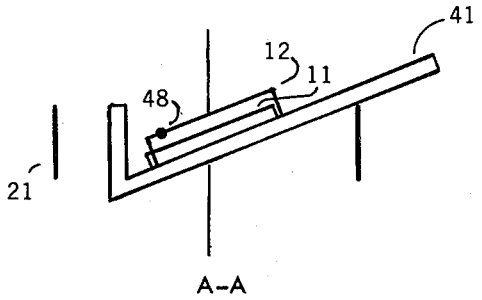

This invention provides a means for controlling the position of the upper edge of the coin so that the closest approach of the coin to the winding is fixed regardless of the thickness of the coin. For convenience this mechanism is referred to as an acute vertex slot and is depicted in FIG. 4B. The acute vertex slot consists of a descending portion 41 and side portions 45 and 46.

The side walls 45 and 46 of the acute vertex are positioned so that their line of intersection is parallel to the axis 10 of the windings 21. When a coin is moved down the descending portion 41 of the acute vertex it is the upper edge of the coin which is restrained by contact with the side walls. As shown the closest approach of the thin coin 11 and the thick coin 12 are the same. The curved surface of the coins is not tangent to the side walls of the acute vertex. Only the edge of the upper surface comes in contact with the side walls forming two points of tangency 47 and 48.

The acute vertex provides a simple and effective means for controlling the closest approach of the coin to the windings a critical factor in providing more uniform sensitivity for large and small diameter coins, and at the same time providing the precise positioning of the V-slot. An additional advantage of the acute vertex is that it tends to clamp or wedge the coin against the descending portion of the vertex by exerting restraining force on the upper edge of the coin.

Figure 2:
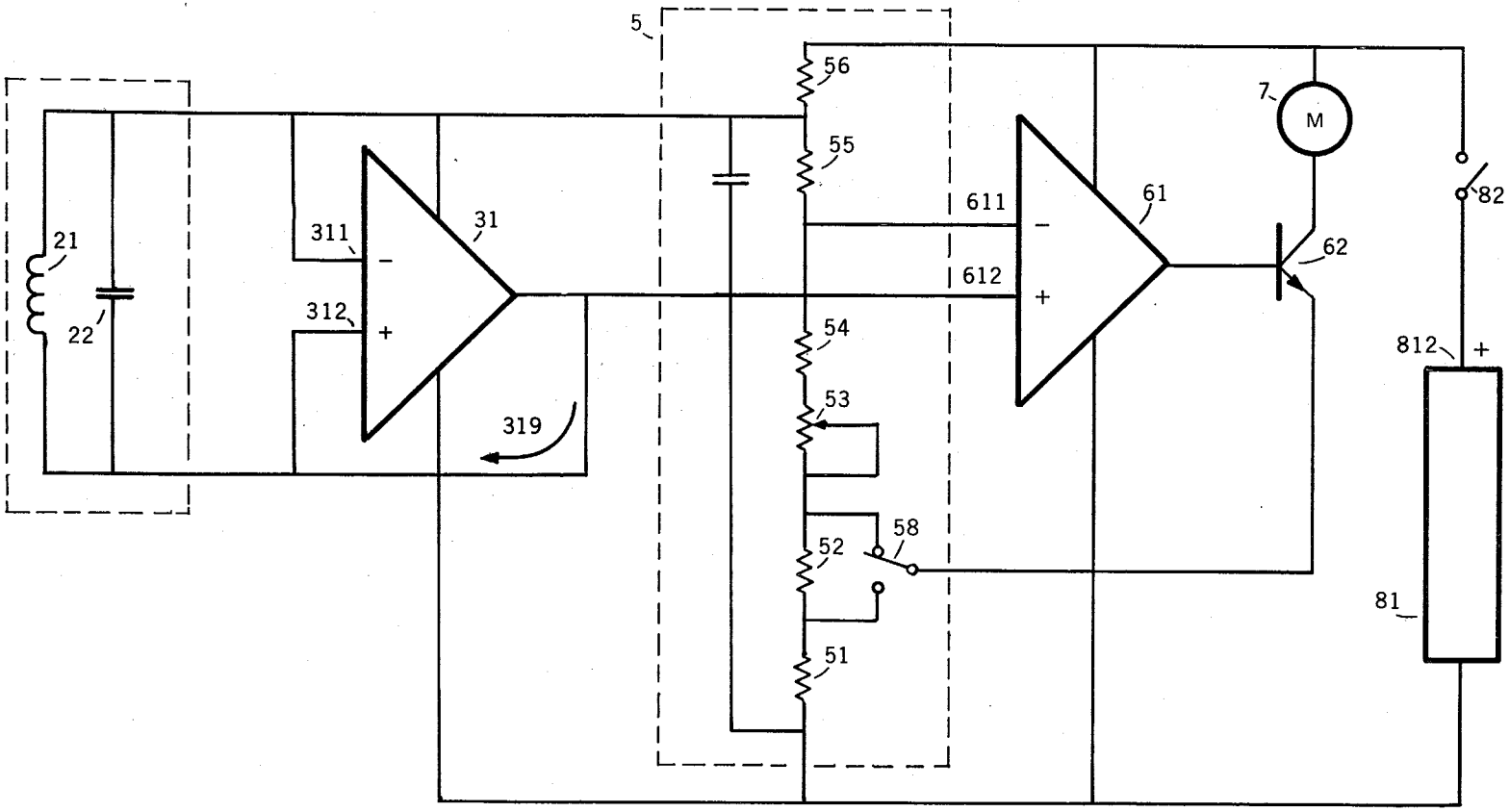
FIG. 2 is a more specific system in accordance with this invention showing the generalized elements in terms of amplifiers and passive elements.

The preferred embodiment of the invention appears in FIG. 2. The oscillator employs a parallel resonant circuit 2 consisting of inductor 21 and capacitance 22. These elements determine the frequency of oscillation. The coin to be tested is introduced into the field of the inductor 21. The resonant circuit is connected to the output terminal of the differential amplifier 31.

The functional elements of the invention are shown in FIG. 1. They consist in part of a resonant circuit 2 which determines the frequency of the oscillator 3. The inductance coil 21 of the resonant circuit is electromagnetically coupled to the coin 1 to be examined. The amplitude of the oscillations is a function of the oscillator energy dissipated in the coin.

The indicator circuit 4 measures the amplitude of the oscillations by comparing it against a reference voltage from coupling network 5 and amplifing the difference in amplifier 61. The output of the amplifier (a) causes the meter 7 to deflect as a measure of the coin's properties and (b) provides a feedback into the coupling network, which modifies the amplifier reference voltage so that in the final state the meter indicates the feedback current neccessary to bring the reference voltage to equivalence with the amplitude of the oscillations. Although this indicator circuit is unique in itself, the principal of negative feedback is well known to those skilled in the art for its ability to provide a precise and stable indication of the function measured.

Referring to FIG. 2 which shows the invention in more detail, the oscillator is seen to incorporate a direct coupled high gain amplifier 31. The amplifier provides an output current 319 proportional to the voltage difference between the input terminals 311 and 312. The positive gain input terminal 312 is connected to the output terminal so that when the output current flows through the parallel resonant circuit consisting of inductor 21 and capacitor 22 a voltage is generated which is fed to the positive input terminal causing a further increase in output current. The fact that an increase in voltage across the resonant circuit leads to an increase in current through the resonant circuit is the manifestation of a negative resistance. The negative resistance of the amplifier overcomes the losses in the resonant circuit and allows oscillating currents to build up to a point where the energy lost in each cycle is equally supplied by the amplifier. Since a major source of losses is due to the presence of a coin placed in or near the inductor, the amplitude of the oscillations will be a measure of losses in the coin.

The voltage developed across the resonant circuit is connected to the positive gain input terminal 612 of amplifier 61. The inverting gain input terminal 611 of amplifier 61 is connected to a reference point on the coupling network. Amplifier 61 is constructed so as to respond to the difference between the peak negative excursion of the oscillator voltage and the voltage at the reference point on the coupling network. This voltage difference is amplified and applied to the base terminal 621 of transistor 62. In this configuration the transistor base current is about 2% or less of the emitter current 622 so that about 98% of the emitter current flows through the collector terminal 623 and serves to deflect the meter 7 before returning through switch 82 to the positive terminal 812 of the battery 81. The emitter current returns to the negative terminal 811 of the battery through resistor 51 or the combination resistors 51 and 52.

The current 622 which flows into the coupling network is nearly equal to the meter current. The voltage drop developed in resistor 51 and 52 by the passage of the meter current is coupled to the inverting terminal 611 of the amplifier through resistors 53, 54 and 55. The resistor network is designed so that the currents required for full scale deflection of the meter, when coupled back to the amplifier terminal, are at least sufficient to compensate for the range of oscillator amplitude encountered in coin testing. The result is that in spite of variations of circuit elements in amplifier 61 or of transistor 62, the meter deflection is accurately a measure of the oscillator amplitude.

Switch 58 directs the meter current return path through resistor 51 or through resistors 51 and 52 in series. In the former case, the total voltage drop caused by the meter current and its effectiveness in matching oscillator amplitude variations is decreased. A greater change in meter current will now be required to compensate for a given change in oscillator amplitude than would be required in the latter case. Thus switch 58 provides a simple and effective means of controlling the meter sensitivity to amplitude changes.

A further feature of the invention is found in the fact that both the amplitude of oscillations and the coupling network reference voltage at amplifier terminal 611 vary as the battery voltage varies. As a result the invention is relatively insensitive to variations in battery voltage.

Figure 3:
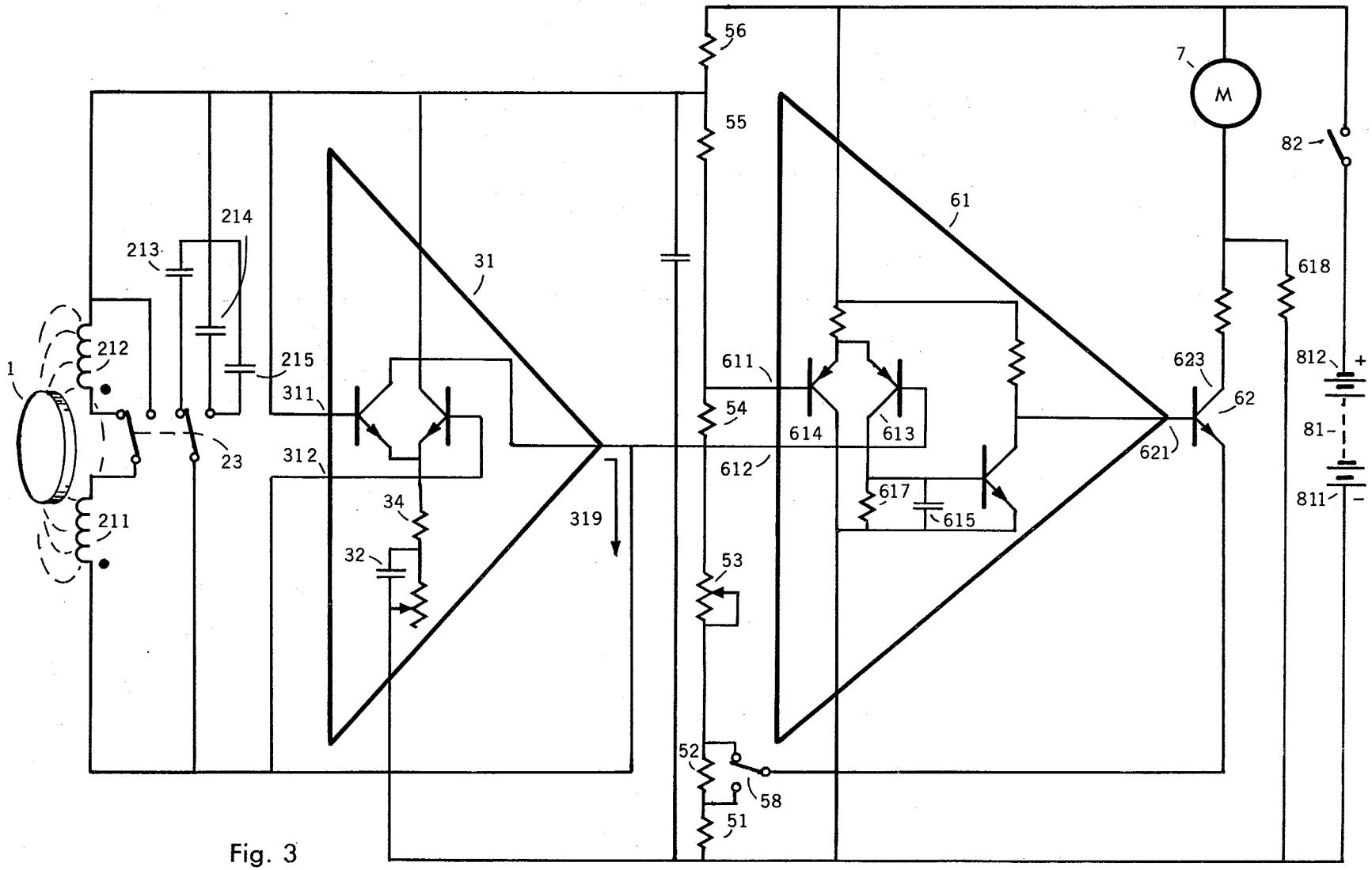
FIG. 3 is a circuit diagram in accordance with the invention wherein details of the amplifiers are shown.

The complete schematic of preferred implementation is shown in FIG. 3. The amplifier 31 which serves as the oscillator is seen to provide an output current 319 as a function of the differential input voltage as measured between the positive gain input terminal 312 and the negative gain input terminal 311. An increasing positive voltage on terminal 312 causes the output current 319 to increase while such a voltage applied to terminal 311 would cause the output current to decrease.

The primary path of this current is through resonant circuit 2 and then to the positive terminal of the battery through the coupling network. Since there is almost no resistance in the resonant circuit, the steady state voltage at terminal 312 is nearly the same as that at terminal 311.

The circuit produces oscillating currents since the increase in the flow of any current in the impedance of the resonant circuit causes an increase in the voltage across the amplifier input terminals and a further increase in amplifier output current. The build up continues until the amplifier can no longer increase the current and the process reverses. Since some of the input current is inductively coupled into the coin being evaluated the nature of the coin will affect the reversal point and hence the amplitude of oscillations. The amplifier output current and hence the amplitude of the oscillator voltage is controlled by resistor 32 and 34. As resistor 32 is increased, the current available to the output is decreased and the amplitude of the oscillator voltage is decreased.

Resistor 32 is used in operation of this invention to set the meter deflection for a particular coin, ingot of bullion or other article. A coin of known quality is placed in the field of the inductor and the meter is set to midscale or other convenient deflection using resistor 32. A coin of unknown quality is then substituted. Any difference in meter deflection is an indication of a difference in coin material or size. Resistor 32 also provides a means of determining the condition of charge of the battery. If the battery is charged, advancing resistor 32 to a maximum resistance will result in at least a full scale deflection of the meter.

This invention uses an oscillator which requires only a two terminal resonant circuit. Although two terminal oscillators are known to those skilled in the art, they have not generally been adopted to coin testing although their advantages are manifold. Use of a two terminal oscillator is a substantial improvement over prior methods in simplicity and economy of construction, and in that changing frequency can be accomplished simply. In this invention, switch 23 allows inductor 212 to be added in series with inductor 211 and capacitors 214 and 215 to be substituted for capacitor 213. This switching is a simple but effective means of changing the frequency of oscillations. The ability to change the frequency of oscillation is important to coin testing. Lower frequencies penetrate more deeply into the material of the coin under test and provide a means of investigating the internal structure of the coin. Higher frequencies provide a means of investigating the characteristics of the coin near the surface of the coin. Inductors 211 and 212 are wound together to form the test inductor. The invention achieves a ratio of five to one in the frequencies determined by switch 23. The lower frequency being on the order of 100,000 Hertz and the higher on the order of 500,000 Hertz. The invention is not restricted to these frequencies or to this range of frequencies.

These frequencies are found particularly useful in testing common coins.

The voltage developed across the coil 21 is coupled to the indicator amplifier 61 terminal 612. The voltage difference between terminals 612 and 611 is amplified by the differential amplifier consisting of transistors 613 and 614, causing the current in the collector of transistor 613 to vary about the quiescent value. This current tends to charge capacitor 615 but since the collector current never reverses, it never tends to discharge the capacitor. Discharge takes place only through the base of transistor 616 or through resistor 617. The values of the elements in these paths are such as to allow only a very small discharge during one cycle of oscillation. As a result, capacitor 615 tends to charge to a steady voltage which approaches the product of the average collector current and the discharge resistance. This voltage is proportional to the difference between the negative peak of the oscillating voltage and the value of the reference steady state voltage applied by the coupling network to terminal 611. This unique feature of the indicator allows a direct comparison of the oscillator amplitude and the steady state reference voltage, and as will be shown, the precise measurement of the former by the latter.

The steady state voltage across capacitor 615 is further amplified by transistor 616 whose collector terminal is the output of the amplifier.

The indicator amplifier drives the base of transistor 62. Transistor 62 provides the unique function of controlling the current through the indicating meter 7 and the feedback current into the coupling network 5. It is a basic property of transistors that the collector current is less than the emitter current network by a factor commonly between 98% and 100%. The feedback current to the coupling network is thus essentially equal to the meter current.

As previously stated, the input to the indicator amplifier is the difference between the peak voltage developed across the inductor and the steady state voltage developed across resistor 55. The steady state component of the inductor voltage is negligible since the coil has a low resistance. The feedback current from transistor 62 decreases the current flowing through resistor 55 in proportion to the difference voltage so as to reduce the difference voltage at the input of the amplifier nearly to zero. The feedback current which is required to zero the differential input voltage is determined by the coupling network resistor 51 or resistors 51 and 52 as determined by switch 58 together with resistors 53, 54, 55 and 56. In the preferred implementation, the resistance of resistors 51 and 52 together is approximately 2½ times the resistance of resistor 51 alone. As a result, full scale deflection of the meter would be 2½ times as effective in zeroing changes of oscillator level when resistors 51 and 52 are selected as when resistor 51 alone is selected. Consequently, the sensitivity of meter current to changes in amplitude of oscillations is 2½ times as great in the latter case than in the former case.

Switch 58 provides a means of altering the system sensitivity, a feature which adds substantially to the utility of the invention. The ratio of 2½ is not essential to the function of the invention. It could be 2 or 5 or 10 or any other reasonable ratio and in fact switch 58 could provide not 2 but 3 or more distinct values of sensitivity.

Resistor 53 is adjustable and provides a means of standardizing the performance for the units as manufactured. Resistor 618 provides a standing current in the meter to indicate that the battery switch is in the "on" position. The current through resistor 618 does not materially affect the sensitivity of the system or the feedback "zeroing".

The method and apparatus specified herein provides a unique and useful means of testing coins. The usefulness is increased because the test may be applied in a dynamic or in a static situation since it does not require movement of the coin for its operation. The invention's usefulness extends beyond its application to coins. It generally provides a means of non-destructive testing and comparison of similarly shaped metallic articles. It could be used for evaluating the inner structure of electronic components such as capacitors or conductors. It could be used for evaluating the inner structure of such simple articles as machine screws. The scope of the invention is by no means limited to coin testing. Any modifications or applications which may occur to those skilled in the art should be considered within the scope of the invention.

What is claimed is:

1. A means of positioning coins within the field of a substantially cylindrical inductor comprising three substantially plane restraining surfaces and a right circular cylinder having first and second bases; the first and second of said surfaces being portions of planes which intersect in a line parallel to the axis of said cylindrical inductor, the third surface being a portion of a plane which intersects the first base of said cylindrical inductor and proceeding in the direction of the second base, forms a vertex with said first and second planes so that a coin moving down the ramp formed by the third surface is restrained in said vertex.

2. A means of positioning coins within the field of a cylindrical inductor according to claim 1 where the intersection of said first and second planes is within the curved surface of the of said inductor.

3. A means of positioning coins within the field of a cylindrical inductor according to claim 1 where said descending ramp forms equal dihedral angles with said first and second planes.

4. A coin positioning receptacle for positioning coins within the field of a substantially cylindrical inductor comprising portions of the three lateral faces of a tetrahedron which would be formed by a base in a plane extending normal to an edge formed by two of the lateral faces.

5. A coin positioning receptacle according to claim 4 in which the plane of the base of said tetrahedron is parallel to the base surfaces of a substantially cylindrical inductor which partially contains said tetrahedron.

6. A coin positioning receptacle according to claim 5 in which the third lateral face of said tetrahedron forms a descending ramp from the first base of said cylindrical inductor toward the second base.

7. A device for analyzing metallic articles comprising:

an inductance capacitance resonant circuit arranged so that said inductance is inductively coupled to the article to be analyzed;

a differential input amplifier whose input is connected to the terminals of said inductor, whose output current is connected to a terminal of said inductor so as to increase the amplifier input voltage and whose current level can be adjusted;

a feedback metering circuit comprising a differential amplifier incorporating rectifying and filtering means, a feedback network coupling a portion of the amplifier output current to an input of said amplifier to reduce the output current and a meter connected to measure the output current of said amplifier.

8. A device for analyzing metallic articles according to claim 7 wherein said feedback network includes a means for adjusting the amount of the amplifier output current coupled to the input of said amplifier.

9. A device for analyzing metallic articles according to claim 7 which includes a means of establishing a constant level of current through said meter to verify that the device is turned on.

10. A device according to claim 7 wherein the current output of the differential amplifier is connected to said metering circuit and where the current level of said differential amplifier can be increased to cause deflection of said meter to a standard point and provide a self-test capability for the device.

11. A method for measuring alternating currents comprising the steps of amplifying the difference between the alternating voltage to be measured and a direct voltage, rectifying and filtering the amplified difference, feeding back a portion of said amplified and filtered voltage to the direct voltage input of said amplifier so as to reduce said amplified and filtered voltage and measuring the magnitude of said amplified and filtered voltage.

* * * * *